US008404083B2

(12) United States Patent
Haehnle et al.

(10) Patent No.: US 8,404,083 B2
(45) Date of Patent: Mar. 26, 2013

(54) PROCESS FOR INCREASING THE DRY STRENGTH OF PAPER, BOARD AND CARDBOARD

(75) Inventors: Hans-Joachim Haehnle, Neustadt (DE); Christian Jehn-Rendu, Eppelheim (DE); Rainer Blum, Mannheim (DE); Ellen Krueger, Otterstadt (DE); Norbert Schall, Roemerberg (DE); Martin Ruebenacker, Altrip (DE)

(73) Assignee: BASF SE, Ludwigshafen (DE)

( * ) Notice: Subject to any disclaimer, the term of this patent is extended or adjusted under 35 U.S.C. 154(b) by 49 days.

(21) Appl. No.: 13/058,217

(22) PCT Filed: Aug. 10, 2009

(86) PCT No.: PCT/EP2009/060331

§ 371 (c)(1),
(2), (4) Date: Feb. 9, 2011

(87) PCT Pub. No.: WO2010/020551

PCT Pub. Date: Feb. 25, 2010

(65) Prior Publication Data

US 2011/0132559 A1 Jun. 9, 2011

(30) Foreign Application Priority Data

Aug. 18, 2008 (EP) ..... 08162545

(51) Int. Cl.
*D21H 11/00* (2006.01)

(52) U.S. Cl. ..... 162/164.6

(58) Field of Classification Search ..... 162/164.6, 162/164.5

See application file for complete search history.

(56) References Cited

U.S. PATENT DOCUMENTS

| | | | |
|---|---|---|---|
| 2,182,306 | A | 12/1939 | Ulrich et al. |
| 3,203,910 | A | 8/1965 | Wilson |
| 4,066,494 | A | 1/1978 | Scharf et al. |
| 4,749,444 | A | 6/1988 | Lorz et al. |
| 6,616,807 | B1 | 9/2003 | Dyllick-Brenzinger et al. |
| 2008/0156448 | A1 | 7/2008 | Hund et al. |
| 2008/0196851 | A1 | 8/2008 | Hund et al. |
| 2009/0145566 | A1 | 6/2009 | Esser et al. |
| 2010/0179248 | A1 | 7/2010 | Esser et al. |
| 2010/0181037 | A1 | 7/2010 | Esser et al. |
| 2010/0181038 | A1 | 7/2010 | Esser et al. |
| 2010/0186915 | A1 | 7/2010 | Esser et al. |

FOREIGN PATENT DOCUMENTS

| | | |
|---|---|---|
| CA | 1 110 019 | 10/1981 |
| DE | 24 34 816 | 2/1976 |
| DE | 35 06 832 | 8/1986 |
| DE | 41 05 919 | 8/1992 |
| DE | 43 28 975 | 3/1994 |
| DE | 197 13 755 | 10/1998 |
| DE | 10 2004 056 551 | 5/2006 |
| DE | 10 2005 022 799 | 11/2006 |
| EP | 0 193 111 | 9/1986 |
| EP | 0 223 223 | 5/1987 |
| EP | 0 377 313 | 7/1990 |
| EP | 0 411 400 | 2/1991 |
| EP | 0 438 744 | 7/1991 |
| EP | 0 528 409 | 2/1993 |
| JP | 2000 332416 | 11/2000 |
| WO | 94 12560 | 6/1994 |
| WO | 94 14873 | 7/1994 |
| WO | 97 25367 | 7/1997 |
| WO | 00 67884 | 11/2000 |
| WO | 03 052206 | 6/2003 |
| WO | 2004 061235 | 7/2004 |
| WO | 2006 075115 | 7/2006 |
| WO | 2006 090076 | 8/2006 |
| WO | 2006 120235 | 11/2006 |

OTHER PUBLICATIONS

U.S. Appl. No. 13/100,522, filed May 4, 2011, Jehn-Rendu, et al.
U.S. Appl. No. 13/376,509, filed Dec. 6, 2011, Jehn-Rendu, et al.
International Search Report issued Dec. 2, 2009 in PCT/EP09/060331 filed Aug. 10, 2009.
U.S. Appl. No. 12/990,763, filed Nov. 2, 2010, Esser, et al.
U.S. Appl. No. 12/996,668, filed Dec. 7, 2010, Haehnle, et al.

*Primary Examiner* — Mark Halpern
(74) *Attorney, Agent, or Firm* — Oblon, Spivak, McClelland, Maier & Neustadt, L.L.P.

(57) ABSTRACT

Process for the production of paper, board and cardboard having high dry strength by addition of at least one water-soluble (a) polymer comprising vinylamine units and at least one (b) polymer comprising ethylenimine units and at least one water-soluble polymeric anionic compound to a paper stock, draining of the paper stock with sheet formation and drying of the paper products, the water-soluble cationic polymers (a) and (b) being metered in any sequence or as a mixture into a paper stock, and papers which are obtainable by this process.

16 Claims, No Drawings

PROCESS FOR INCREASING THE DRY STRENGTH OF PAPER, BOARD AND CARDBOARD

This application is a 371 of PCT/EP2009/060331 filed 10 Aug. 2009.

The invention relates to a process for the production of paper, board and cardboard having high dry strength by addition of at least one cationic polymer and a polymeric anionic compound to a paper stock, draining of the paper stock with sheet formation and drying of the paper products.

Canadian Patent 1 110 019 discloses a process for the production of paper having high dry strength, in which first a water-soluble cationic polymer is added to the paper stock, a water-soluble anionic polymer is then metered, the paper stock is then drained on the paper machine with sheet formation and the paper products are dried. Suitable anionic polymers are, for example, hydrolyzed polyacrylamides, which may have up to 30 mol % of acrylic acid units. Cationic polymers used are, for example, water-soluble homo- and copolymers of cationic monomers, such as vinylpyridine, vinylimidazolidine, diallylamines, ethylenimine and basic acrylates and basic methacrylates. The basic (meth)acrylates can in each case be copolymerized with acrylamide or methacrylamide. These cationic polymers and polyacrylamides can be modified to give further cationic polymers suitable for the process described, for example they can be subjected to a Mannich reaction or a Hofmann degradation.

DE-A 35 06 832 discloses a process for the production of paper having high dry strength, in which first a water-soluble cationic polymer and then a water-soluble anionic polymer are added to the paper stock. Suitable anionic polymers are, for example, homo- or copolymers of ethylenically unsaturated $C_3$- $C_5$-carboxylic acids. The copolymers comprise at least 35% by weight of an ethylenically unsaturated $C_3$-$C_5$-carboxylic acid (e.g. acrylic acid) incorporated in the form of polymerized units. In the examples, polyethylenimine, polyvinylamine, polydiallyldimethylammonium chloride and epichlorohydrin-crosslinked condensates of adipic acid and diethylenetriamine are described as cationic polymers. The use of partly hydrolyzed homo- and copolymers of N-vinylformamide has also been considered.

JP-A 1999-140787 relates to a process for the production of corrugated board, wherein from 0.05 to 0.5% by weight, based on dry paper stock, of a polyvinylamine which is obtainable by hydrolysis of polyvinylformamide with a degree of hydrolysis from 25 to 100%, in combination with an anionic polyacrylamide is added to the paper stock for improving the strength properties of a paper product, the paper stock is then drained with sheet formation and the paper is dried.

WO 03/052206 discloses a paper product having improved strength properties, which is obtainable by applying a polyvinylamine and a polymeric anionic compound which can form a polyelectrolyte complex with polyvinylamine, or a polymeric compound having aldehyde functions, such as polysaccharides comprising aldehyde groups, to the surface of a paper product. Not only is an improvement in the dry and wet strength of the paper obtained but a sizing effect of the treatment compositions is also observed.

WO 2004/061235 discloses a process for the production of paper, in particular tissue, having particularly high wet and/or dry strengths, in which first a water-soluble cationic polymer which comprises at least 1.5 meq of primary amino functions per g of polymer and has a molecular weight of at least 10 000 Dalton is added to the paper stock. Partly and completely hydrolyzed homopolymers of N-vinylformamide are particularly singled out here. Thereafter, a water-soluble anionic polymer which comprises anionic and/or aldehydic groups is added.

DE-A 10 2004 056 551 describes a further process for improving the dry strength of paper. In this process, separate addition of a polymer comprising vinylamine units and of a polymeric anionic compound to a paper stock, draining of the paper stock and drying of the paper products are effected, the polymeric anionic compound used being at least one copolymer which is obtainable by copolymerization of (a) at least one N-vinylcarboxamide of the formula

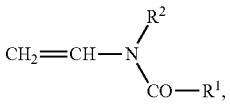

(I)

in which $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule.

WO 2006/075115 discloses the use of Hofmann degradation products of copolymers of acrylamide or of methacrylamide in combination with anionic polymers having an anionic charge density of >0.1 meq/g for the production of paper and cardboard having a high dry strength.

WO 2006/120235 describes a process for the production of papers having a filler content of at least 15% by weight, in which filler and fibers are treated together with cationic and anionic polymers, the treatment being effected alternately with cationic and anionic polymers and comprising at least 3 steps.

WO 2006/090076 likewise relates to a process for the production of paper and board having high dry strength, 3 components being added to the paper stock:

a) a polymer having primary amino groups and a charge density of >1.0 meq/g, b) a second, different cationic polymer having a charge density of >0.1 meq/g, which is obtainable by free radical polymerization of cationic monomers, and c) an anionic polymer having a charge density of >0.1 meq/g.

It is the object of the invention to provide a further process for the production of paper, board and cardboard having high dry strength, the dry strength properties of the paper products being as far as possible further improved compared with those of known products. A further object of the invention is to achieve faster draining of the paper stock compared with known processes.

The objects are achieved, according to the invention, by a process for the production of paper, board and cardboard having high dry strength by addition of at least one water-soluble cationic polymer and at least one water-soluble polymeric anionic compound to a paper stock, draining of the paper stock with sheet formation and drying of the paper products, wherein (a) polymers comprising vinylamine units and (b) polymers comprising ethylenimine units are metered as water-soluble cationic polymers in any sequence or as a mixture into a paper stock.

The invention also relates to papers which are obtainable by the process described above.

Polymers which comprise vinylamine units are known, cf. DE-A 35 06 832 and DE-A 10 2004 056551 mentioned in relation to the prior art. In the process according to the invention, for example, the reaction products which are obtainable by polymerization of at least one monomer of the formula

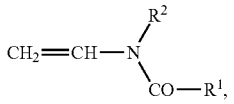

(I)

in which $R^1$, $R^2$ are H or $C_1$- to $C_6$-alkyl, and subsequent partial or complete elimination of the groups —CO-$R^1$ from the units of the monomers (I) incorporated in the form of polymerized units into the polymer with formation of amino groups and/or by Hofmann degradation of polymers which have acrylamide and/or methacrylamide units are used as (a) polymers comprising vinylamine units.

For example, the reaction products which are obtainable by polymerization of (i) at least one monomer of the formula

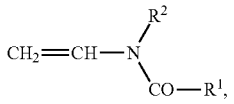

(I)

in which $R^1$, $R^2$ are H or $C_1$- to $C_6$-alkyl, (ii) at least one other monoethylenically unsaturated monomer and, if appropriate, (iii) at least one crosslinking monomer having at least two double bonds in the molecule and subsequent partial or complete elimination of the groups —CO-$R^1$ from the units of the monomers (I) incorporated in the form of polymerized units into the polymer with formation of amino groups are used as (a) polymers comprising vinylamine units.

The polymers comprising vinylamine units may also be amphoteric if they have an overall cationic charge. The content of cationic groups in the polymer should be at least 5 mol %, preferably at least 10 mol % above the content of anionic groups. Such polymers are obtainable, for example, by polymerization of (i) at least one monomer of the formula

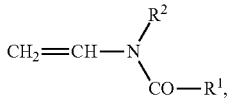

(I)

in which $R^1$, $R^2$ are H or $C_1$- to $C_6$-alkyl, (ii,a) at least in each case one monoethylenically unsaturated sulfonic acid, one monoethylenically unsaturated phosphonic acid, one monoethylenically unsaturated carboxylic acid having 3 to 8 carbon atoms in the molecule and/or the alkali metal, alkaline earth metal or ammonium salts thereof and, if appropriate, (ii,b) at least one other neutral and/or one cationic monomer and, if appropriate, (iii) at least one crosslinking monomer having at least two double bonds in the molecule and subsequent partial or complete elimination of groups —CO-$R^1$ from the monomers of the formula I which are incorporated in the form of polymerized units into the polymer with formation of amino groups, the content of amino groups in the copolymer being at least 5 mol % above the content of acid groups of the monomers (ii,a) which are incorporated in the form of polymerized units.

Preferably, the reaction products which are obtainable by polymerization of N-vinylformamide and subsequent elimination of formyl groups from the vinylformamide units incorporated in the form of polymerized units into the polymer with formation of amino groups are used as (a) polymers comprising vinylamine units or the reaction products which are obtainable by copolymerization of (i) N-vinylformamide and (ii) acrylonitrile and subsequent elimination of formyl groups from the vinylformamide units incorporated in the form of polymerized units into the copolymer with formation of amino groups are used.

Also of interest are amphoteric polymers which comprise vinylamine units, carry an overall cationic charge and, for example, are obtainable by copolymerization of (i) N-vinylformamide, (ii,a) acrylic acid, methacrylic acid and/or the alkali metal, alkaline earth metal or ammonium salts thereof and, if appropriate, (ii,b) acrylonitrile and/or methacrylonitrile and subsequent partial or complete elimination of formyl groups from the N-vinylformamide incorporated in the form of polymerized units into the polymer with formation of amino groups, the content of amino groups in the copolymer being at least 5 mol % above the content of acid groups of the monomers (ii,a) which are incorporated in the form of polymerized units.

Examples of monomers of the formula I are N-vinylformamide, N-vinyl-N-methylformamide, N-vinylacetamide, N-vinyl-N-methylacetamide, N-vinyl-N-ethylacetamide, N-vinylpropionamide, N-vinyl-N-methylpropionamide and N-vinylbutyramide. The monomers of group (i) can be used alone or as a mixture in the copolymerization with the monomers of the other groups. A preferably used monomer of this group is N-vinylformamide.

These polymers can, if appropriate, be modified by copolymerizing the N-vinylcarboxamides (i) together with (ii) at least one other monoethylenically unsaturated monomer and then hydrolyzing the copolymers with formation of amino groups. If anionic monomers are used in the copolymerization, the hydrolysis of the vinyicarboxamide units incorporated in the form of polymerized units is continued until the molar excess of amine units relative to the anionic units in the polymer is at least 5 mol %.

Examples of monomers of group (ii) are esters of α,β-ethylenically unsaturated mono- and dicarboxylic acids with $C_1$-$C_{30}$-alkanols, $C_2$-C30-alkanediols and $C_2$-$C_{30}$-aminoalcohols, amides of α,β-ethylenically unsaturated monocarboxylic acids and the N-alkyl and N-N-dialkyl derivatives thereof, nitriles of α,β-ethylenically unsaturated mono- and dicarboxylic acids, esters of vinyl alcohol and allyl alcohol with $C_1$-$C_{30}$-monocarboxylic acids, N-vinyllactams, nitrogen-containing heterocycles having α,β-ethylenically unsaturated double bonds, vinylaromatics, vinyl halides, vinylidene halides, $C_2$-$C_8$-monoolefins and mixtures thereof.

Suitable representatives are, for example, methyl (meth) acrylate (here as well as in the following text, this notation indicates both "acrylates" and "methacrylates"), methyl ethacrylate, ethyl (meth)acrylate, ethyl ethacrylate, n-butyl (meth)acrylate, isobutyl (meth)acrylate, tert-butyl (meth) acrylate, tert-butyl ethacrylate, n-octyl (meth)acrylate, 1,1,3, 3-tetramethylbutyl (meth)acrylate, ethylhexyl (meth)acrylate and mixtures thereof. Suitable additional monomers of group (ii) are furthermore the esters of α,β-ethylenically unsaturated mono- and dicarboxylic acids with aminoalcohols, preferably $C_2$-$C_{12}$-aminoalcohols. These may be $C_1$-$C_8$-monoalkylated or -dialkylated on the amine nitrogen. For example, acrylic acid, methacrylic acid, fumaric acid, maleic acid, itaconic acid, crotonic acid, maleic anhydride, monobutyl maleate and mixtures thereof are suitable as the acid component of these esters. Acrylic acid, methacrylic acid and mixtures thereof are preferably used. These include, for example, N-methylaminomethyl (meth)acrylate, N-methylaminoethyl (meth)acrylate, N,N-dimethylaminomethyl (meth)acrylate, N,N-dimethylaminoethyl (meth)acrylate, N,N-diethylaminoethyl (meth)acrylate, N,N-dimethylaminopropyl (meth)acrylate, N,N-diethylaminopropyl (meth) acrylate and N,N-dimethylaminocyclohexyl (meth)acrylate.

2-Hydroxyethyl (meth)acrylate, 2-hydroxyethyl ethacrylate, 2-hydroxypropyl (meth)acrylate, 3-hydroxypropyl (meth)acrylate, 3-hydroxybutyl (meth)acrylate, 4-hydroxybutyl (meth)acrylate, 6-hydroxyhexyl (meth)acrylate and mixtures thereof are furthermore suitable as monomers of group (ii).

Suitable additional monomers of group (ii) are furthermore acrylamide, methacrylamide, N-methyl(meth)acrylamide, N-ethyl(meth)acrylamide, n-propyl(meth)acrylamide, N-(n-butyl)(meth)acrylamide, tert-butyl(meth)acrylamide, n-octyl (meth)acrylamide, 1,1,3,3-tetramethylbutyl(meth)acrylamide, ethylhexyl(meth)acrylamide and mixtures thereof.

In addition, N-[2-(dimethylamino)ethyl]acrylamide, N-[2-(dimethylamino)ethyl]methacrylamide, N-[3-(dimethylamino)propyl]acrylamide, N-[3-(dimethylamino)propyl] methacrylamide, N[4-(dimethylamino)butyl]acrylamide, N-[4-dimethylamino)butyl]methacrylamide, N-[2-(diethylamino)ethyl]acrylamide, N-[2-(diethylamino)ethyl]methacrylamide and mixtures thereof are suitable as further monomers of group (ii).

Further examples of monomers of group (ii) are nitriles of α,β-ethylenically unsaturated mono- and dicarboxylic acids, such as, for example, acrylonitrile and methacrylonitrile. The presence of units of these monomers in the copolymer leads, during or after the hydrolysis, to products which have amidine units, cf. for example EP-A 0 528 409 or DE-A 43 28 975. In the hydrolysis of N-vinylcarboxamide polymers, a secondary reaction does in fact result in the formation of amidine units by reaction of vinylamine units with a neighboring vinylformamide unit or—if a nitrile group is present as a neighboring group in the polymer—with said nitrile group. Below, the indication of vinylamine units in the amphoteric copolymers or in unmodified homo- or copolymers always means the sum of vinylamine and amidine units.

Suitable monomers of group (ii) are furthermore N-vinyllactams and derivatives thereof which may have, for example, one or more $C_1$-C6-alkyl substituents (as defined above). These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Further suitable monomers of group (ii) are N-vinylimidazoles and alkylvinylimidazoles, in particular methylvinylimidazoles, such as, for example, 1-vinyl-2-methylimidazole, 3-vinylimidazole N-oxide, 2- and 4-vinylpyridine N-oxides and betaine derivatives and quaternization products of these monomers and ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

The abovementioned monomers can be used individually or in the form of any desired mixtures. Typically, they are used in amounts of from 1 to 90 mol %, preferably from 10 to 80 mol % and particularly preferably from 10 to 60 mol %.

For the preparation of amphoteric copolymers, anionic monomers, which are referred to above as monomers (ii,a), are also suitable as other monoethylenically unsaturated monomers of group (ii). They can, if appropriate, be copolymerized with the neutral and/or cationic monomers (ii,b) described above. The amount of anionic monomers (ii,a) is, however, not more than 45 mol% in order for the amphoteric copolymer formed to have an overall cationic charge.

Examples of anionic monomers of group (ii,a) are ethylenically unsaturated $C_3$- to $C_8$-carboxylic acids, such as, for example, acrylic acid, methacrylic acid, dimethacrylic acid, ethacrylic acid, maleic acid, fumaric acid, itaconic acid, mesaconic acid, citraconic acid, methylenemalonic acid, allylacetic acid, vinylacetic acid and crotonic acid. Other suitable monomers of this group are monomers comprising sulfo groups, such as vinyl sulfonic acid, acrylamido-2-methyl-propanesulfonic acid and styrene sulfonic acid, and monomers comprising phosphono groups, such as vinyl phosphonic acid. Monomers of this group can be used alone or as a mixture with one another, in partly or in completely neutralized form in the copolymerization. For example, alkali metal or alkaline earth metal bases, ammonia, amines and/or alkanolamines are used for neutralization. Examples of these are sodium hydroxide solution, potassium hydroxide solution, sodium carbonate, potassium carbonate, sodium bicarbonate, magnesium oxide, calcium hydroxide, calcium oxide, triethanolamine, ethanolamine, morpholine, diethylenetriamine or tetraethylenepentamine.

A further modification of the copolymers is possible by using, in the copolymerization, monomers of group (iii) which comprise at least two double bonds in the molecule, e.g. triallylamine, methylenebisacrylamide, glycol diacrylate, glycol dimethacrylate, glyceryl triacrylate, pentaerythrityl triallyl ether, polyalkylene glycols at least diesterified with acrylic acid and/or methacrylic acid or polyols, such as pentaerythritol, sorbitol or glucose. If at least one monomer of the above group is used in the polymerization, the amounts used are up to 2 mol %, e.g. from 0.001 to 1 mol %.

Furthermore, for modification of the polymers, it may be expedient to combine the use of above crosslinking agents with the addition of regulators. From 0.001 to 5 mol % are typically used. All regulators known from literature, for example sulfur compounds, such as mercaptoethanol, 2-ethylhexyl thioglycolate, thioglycolic acid and dodecyl mercaptan, and sodium hypophosphite, formic acid or tribromochloromethane may be used.

The polymers comprising vinylamine units also include hydrolyzed graft polymers of, for example, N-vinylformamide on polyalkylene glycols, polyvinyl acetate, polyvinyl alcohol, polyvinylformamides, polysaccharides, such as starch, oligosaccharides or monosaccharides. The graft polymers are obtainable by, for example, subjecting N-vinylformamide to free radical polymerization in an aqueous medium in the presence of at least one of said grafting bases, if appropriate together with copolymerizable other monomers, and then hydrolyzing the grafted-on vinylformamide units in a known manner to give vinylamine units.

The hydrolysis of the copolymers can be carried out in the presence of acids or bases or enzymatically. In the hydrolysis with acids, the vinylamine groups forming from the vinylcarboxamide units are present in salt form. The hydrolysis of vinylcarboxamide copolymers is described in detail in EP-A 0 438 744, page 8, line 20 to page 10, line 3. The statements made there apply in a corresponding manner to the preparation of the purely cationic and/or amphoteric polymers to be used according to the invention, comprising vinylamine units and having an overall cationic charge. The polymers comprising vinylamine units can also be used in the form of the free bases in the process according to the invention. Such polymers are obtained, for example, in the hydrolysis of polymers comprising vinylcarboxylic acid units with bases.

Polymers comprising vinylamine units have, for example, K values (determined according to H. Fikentscher in 5% strength aqueous sodium chloride solution and pH 7, a polymer concentration of 0.5% by weight and a temperature of 25° C.) in the range from 20 to 250, preferably from 50 to 150.

The preparation of the above-described homo- and copolymers comprising vinylamine units can be effected by solution, precipitation, suspension or emulsion polymerization. Solution polymerization in aqueous media is preferred. Suitable aqueous media are water and mixtures of water and at least one water-miscible solvent, e.g. an alcohol, such as methanol, ethanol, n-propanol or isopropanol. The cationic polymers are water-soluble. The solubility in water at a temperature of 20° C., 1013 mbar and a pH of 7.0 is, for example, at least 5% by weight, preferably at least 10% by weight.

The charge density of the cationic polymers (without counterions) is, for example, at least 1.0 meq/g and is preferably in the range from 4 to 10 meq/g.

The reaction products which are obtainable by Hofmann degradation of homo- or copolymers of acrylamide or of methacrylamide in an aqueous medium in the presence of sodium hydroxide solution and sodium hypochlorite and subsequent decarboxylation of the carbamate groups of the reaction products in the presence of an acid are also suitable as (a) polymers comprising vinylamine units. Such polymers are disclosed, for example, in EP-A 0 377 313 and WO 2006/075115. The preparation of polymers comprising vinylamine groups is discussed in detail, for example, in WO 2006/075115, page 4, line 25 to page 10, line 22, and in the examples on pages 13 and 14. The statements made there apply to the characterization of the polymers prepared by Hofmann degradation and comprising vinylamine units.

Polymers which comprise acrylamide and/or methacrylamide units are used as starting material. These are homo- or copolymers of acrylamide and methacrylamide. Suitable comonomers are, for example, dialkylaminoalkyl(meth)acrylamides, diallylamine, methyldiallylamine and the salts of the amines and the quaternized amines. Also suitable as comonomers are dimethyldiallylammonium salts, acrylamidopropyltrimethylammonium chloride and/or methacrylamidopropyltrimethylammonium chloride, N-vinylformamide, N-vinylacetamide, N-vinylpyrrolidone, vinyl acetate and acrylates and methacrylates. If appropriate, anionic monomers, such as acrylic acid, methacrylic acid, maleic anhydride, maleic acid, itaconic acid, acrylamidomethylpropanesulfonic acid, methallylsulfonic acid and vinylsulfonic acid and the alkali metal, alkaline earth metal and ammonium salts of said acidic monomers are also suitable as comonomers, not more than 5 mol % of these monomers being used in the polymerization. The amount of water-insoluble monomers is chosen in the polymerization so that the resulting polymers are soluble in water.

If appropriate, crosslinking agents, for example ethylenically unsaturated monomers which comprise at least two double bonds in the molecule, such as triallylamine, methylenebisacrylamide, ethylene glycol diacrylate, ethylene glycol dimethacrylate, polyethylene glycol dimethacrylate, triallylamine and trimethylol trimethacrylate, can also be used as comonomers. If a crosslinking agent is used, the amounts used are, for example, from 5 to 5000 ppm. The polymerization of the monomers can be effected by all known processes, for example by free radical solution, precipitation or suspension polymerization. If appropriate, the procedure can be effected in the presence of customary polymerization regulators.

In the Hofmann degradation, for example, from 20 to 40% strength by weight aqueous solutions of at least one polymer comprising acrylamide and/or methacrylamide units are used as starting material. The ratio of alkali metal hypochlorite to (meth)acrylamide units in the polymer is decisive for the resulting content of amine groups in the polymer. The molar ratio of alkali metal hydroxide to alkali metal hypochlorite is, for example, from 2 to 6, preferably from 2 to 5. The amount of alkali metal hydroxide required for the degradation of the polymer is calculated for a certain amino group content in the degraded polymer.

The Hofmann degradation of the polymer is effected, for example, in the temperature range from 0 to 45° C., preferably from 10 to 20° C., in the presence of quaternary ammonium salts as a stabilizer, in order to prevent a secondary reaction of the resulting amino groups with the amido groups of the starting polymer. After the end of the reaction with alkali metal hydroxide solution/alkali metal hypochlorite, the aqueous reaction solution is passed into a reactor in which an acid is initially taken for the decarboxylation of the reaction product. The pH of the reaction product comprising vinylamine units is adjusted to a value of from 2 to 7. The concentration of the degradation product comprising vinylamine units is, for example, more than 3.5% by weight; in general, it is above 4.5% by weight. The aqueous polymer solutions can be concentrated, for example, with the aid of ultrafiltration.

The polymers comprising ethylenimine units include all polymers which are obtainable by polymerization of ethylenimine in the presence of acids, Lewis acids or haloalkanes, such as homopolymers of ethylenimine or graft polymers of ethylenimine, cf. U.S. Pat. No. 2,182,306 or U.S. Pat. No. 3,203,910. These polymers can, if appropriate, be subsequently subjected to crosslinking. Suitable crosslinking agents are, for example, all polyfunctional compounds which comprise groups reactive toward primary amino groups, for example polyfunctional epoxides, such as bisglycidyl ethers of oligo- or polyethylene oxides, or other polyfunctional alcohols, such as glycerol or sugars, polyfunctional carboxylates, polyfunctional isocyanates, polyfunctional acrylates or methacrylates, polyfunctional acrylamides or methacrylamides, epichlorohydrin, polyfunctional acidhalides, polyfunctional nitriles, α,ω-chlorohydrin ethers of oligo- or polyethylene oxides, or of other polyfunctional alcohols, such as glycerol or sugars, divinyl sulfone, maleic anhydride or ω-halocarboxylic acid chlorides, polyfunctional haloalkanes, in particular α,Ω-dichloroalkanes. Further crosslinking agents are described in WO 97/25367, pages 8 to 16.

Polymers comprising ethylenimine units are disclosed, for example, in EP-A-0411400, DE 2434816 and U.S. Pat. No. 4,066,494.

For example, at least one water-soluble cationic polymer from the group consisting of the homopolymers of ethylenimine, polyethylenimines reacted with at least bifunctional crosslinking agents, polyamidoamines which have been grafted with ethylenimine and reacted with at least bifunctional crosslinking agents, reaction products of polyethylenimines with monobasic carboxylic acids to give amidated polyethylenimines, Michael adducts of polyethylenimines with ethylenically unsaturated acids, salts, esters, amides or nitriles of monoethylenically unsaturated carboxylic acids, phosphonomethylated polyethylenimines, carboxylated polyethylenimines and alkoxylated polyethylenimines is used as (b) polymers comprising ethylenimine units in the process according to the invention.

Polymers which are obtained by first subjecting at least one polycarboxylic acid to condensation with at least one polyamine to give polyamidoamines, then effecting grafting with ethylenimine and then crosslinking the reaction products with one of the abovementioned compounds are among the preferred compounds comprising ethylenimine units. A process for the preparation of such compounds is described, for example, in DE-A-2434816, α,ω-chlorohydrin ethers of oligo- or polyethylene oxides being used as crosslinking agents.

Particularly preferred products are those of the two abovementioned types which were subjected to ultrafiltration and thus optimized in their molecular weight distribution. Such products which have been subjected to ultrafiltration are described in detail in WO 00/67884 and WO 97/25367.

Reaction products of polyethylenimines with monobasic carboxylic acids to give amidated polyethylenimines are disclosed in WO 94/12560. Michael adducts of polyethylenimines with ethylenically unsaturated acids, salts, esters, amides or nitriles of monoethylenically unsaturated carboxylic acids form the subject matter of WO 94/14873. Phosphonomethylated polyethylenimines are described in detail in WO 97/25367. Carboxylated polyethylenimines are obtainable, for example, with the aid of a Strecker synthesis by reaction of polyethylenimines with formaldehyde and ammonia/hydrogen cyanide and hydrolysis of the reaction products. Alkoxylated polyethylenimines can be prepared by reacting polyethylenimines with alkylene oxides, such as ethylene oxide and/or propylene oxide.

The polymers comprising ethylenimine units have, for example, molar masses of from 10 000 to 3 000 000. The cationic charge of the polymers comprising ethylenimine units is, for example, at least 4 meq/g. It is in general in the range from 8 to 20 meq/g.

The weight ratio of (a) polymers comprising vinylamine units to (b) polymers comprising ethylenimine units is, for example, from 10:1 to 1:10, preferably from 5:1 to 1:5, in the process according to the invention. The combination of polymers comprising ethylenimine units and polymers comprising vinylamine units is used, for example, in an amount of from 0.01 to 2.0% by weight, preferably from 0.1 to 1.0% by weight, based on dry paper stock, in the process according to the invention for the production of paper.

The water-soluble polymeric anionic compounds include all polymers which carry acid groups or salts thereof and have a charge density of >0.5 meq/g. The acid groups may be carboxyl groups, sulfo groups and phosphonic acid groups. Esters of phosphoric acid are also included here, at least one acid function of the phosphoric acid not being esterified. In principle, polymers, polycondensates, e.g. polyaspartic acid, polyaddition compounds and also compounds prepared by ring-opening polymerization and having a charge density of in each case >0.5 meq/g can be used. Polymers which were modified by polymer-analogous reactions, such as Strecker reaction, or by phosphonomethylation with acidic groups can also be used. However, polymers of the following composition are preferred:

(1) at least one monomer which is selected from the group consisting of (1.1) monoethylenically unsaturated sulfonic acids, phosphonic acids, phosphoric acid esters and derivatives thereof, and (1.2) monoethylenically unsaturated mono- and dicarboxylic acids, salts thereof and dicarboxylic anhydrides, (2) if appropriate, at least one monoethylenically unsaturated monomer differing from the components (1.1) and (1.2), and (3) if appropriate, at least one compound which has at least two ethylenically unsaturated double bonds in the molecule, with the proviso that the monomer mixture comprises at least one monomer (1) having at least one free acid group and/or one acid group in salt form.

Suitable monomers of group (1.1) are compounds which have an organic radical having a polymerizable, α,β-ethylenically unsaturated double bond and at least one sulfo or phosphonic acid group per molecule. The salts and esters of the abovementioned compounds are furthermore suitable. The esters of the phosphonic acids may be the monoesters or the diesters. Suitable monomers (1.1) are furthermore esters of phosphoric acid with alcohols having a polymerizable α,β-ethylenically unsaturated double bond. A proton of the phosphoric acid group or the two remaining protons of the phosphoric acid group can be neutralized by suitable bases or esterified with alcohols which have no polymerizable double bonds.

Suitable bases for the partial or complete neutralization of the acid groups of the monomers (1.1) are, for example, alkali metal or alkaline earth metal bases, ammonia, amines and/or alkanolamines. Examples of these are sodium hydroxide, potassium hydroxide, sodium carbonate, potassium carbonate, sodium bicarbonate, potassium bicarbonate, magnesium hydroxide, magnesium oxide, calcium hydroxide, calcium oxide, triethanolamine, ethanolamine, morpholine, diethylenetriamine or tetraethylenepentamine. Suitable alcohols for esterifying the phosphoric acid are, for example, $C_1$-$C_6$-alkanols, such as, for example, methanol, ethanol, n-propanol, isopropanol, n-butanol, sec-butanol, tert-butanol, n-pentanol, n-hexanol and the isomers thereof.

The monomers (1.1) include, for example, vinylsulfonic acid, allylsulfonic acid, methallylsulfonic acid, sulfoethyl acrylate, sulfoethyl methacrylate, sulfopropyl acrylate, sulfopropyl methacrylate, 2-hydroxy-3-acryloyloxypropylsulfonic acid, 2-hydroxy-3-methacryloyloxypropylsulfonic acid, styrenesulfonic acid, acrylamidomethylenephosphonic acid, 2-acrylamido-2-methylpropanesulfonic acid, vinylphosphonic acid, $CH_2{=}CH{-}NH{-}CH_2{-}PO_3H$, monomethyl vinylphosphonate, dimethyl vinylphosphonate, allylphosphonic acid, monomethyl allylphosphonate, dimethyl allylphosphonate, acrylamidomethylpropylphosphonic acid, (meth)acryloylethylene glycol phosphate and monoallyl phosphate.

If exclusively monomers in which all protons of the acid groups are esterified are used as component (1.1), such as, for example, dimethyl vinylphosphonate or dimethyl allylphosphonate, at least one monoethylenically unsaturated monoand/or dicarboxylic acid or a salt thereof, as described below as component (1.2), is used for the polymerization. It is thus ensured that the copolymers used according to the invention have anionic groups.

The abovementioned monomers (1.1) can be used individually or in the form of any desired mixtures in the preparation of the anionic polymers.

Suitable monomers of group (1.2) are monoethylenically unsaturated carboxylic acids having 3 to 8 carbon atoms and the water-soluble salts, such as alkali metal, alkaline earth metal or ammonium salts, of these carboxylic acids and the monoethylenically unsaturated carboxylic anhydrides. This group of monomers includes, for example, acrylic acid, methacrylic acid, dimethacrylic acid, ethacrylic acid, a-chloroacrylic acid, maleic acid, maleic anhydride, fumaric acid, itaconic acid, mesaconic acid, citraconic acid, glutaconic acid, aconitic acid, methylenemalonic acid, allylacetic acid, vinylacetic acid and crotonic acid. The monomers of group (1.2) can be used alone or as a mixture with one another, in partly or completely neutralized form, in the homo- or copolymerization. Bases suitable for neutralization are the compounds mentioned above in the case of component (1.1).

The water-soluble anionic polymer comprises at least one monomer from the group (1), which is selected from the subgroups (1.1) and/or (1.2). Of course, the water-soluble copolymer may also comprise mixtures of monomers from subgroups (1.1) and (1.2) incorporated in the form of polymerized units.

For modification, the copolymers can, if appropriate, comprise at least one further monomer of group (2) incorporated in the form of polymerized units. Preferably, these monomers are selected from esters of α,β-ethylenically unsaturated mono- and dicarboxylic acids with $C_1$-$C_{30}$-alkanols, $C_2$-$C_{30}$-alkanediols and $C_2$-$C_{30}$-aminoalcohols, amides of α,β-ethylenically unsaturated monocarboxylic acids and the N-alkyl and N,N-dialkyl derivatives thereof, esters of vinyl alcohol and allyl alcohol with $C_1$-$C_{30}$-monocarboxylic acids, N-vinyllactams, nitrogen-containing heterocycles having α,β-ethylenically unsaturated double bonds, vinyl aromatics, vinyl halides, vinylidene halides, $C_2$-$C_8$-monoolefins and mixtures thereof.

Suitable representatives of group (2) are, for example, methyl (meth)acrylate, methyl ethacrylate, ethyl (meth)acrylate, ethyl ethacrylate, n-butyl (meth)acrylate, isobutyl (meth)acrylate, tert-butyl (meth)acrylate, tert-butyl ethacrylate, n-ocytl (meth)acrylate, 1,1,3,3-tetramethylbutyl (meth) acrylate, ethylhexyl (meth)acrylate and mixtures thereof.

Suitable additional monomers (2) are furthermore acrylamide, methacrylamide, N-methyl(meth)acrylamide, N-ethyl (meth)acrylamide, n-propyl(meth)acrylamide, N-(n-butyl) (meth)acrylamide, tert-butyl(meth)acrylamide, n-octyl (meth)acrylamide, 1,1,3,3-tetramethylbutyl(meth) acrylamide, ethylhexyl(meth)acrylamide and mixtures thereof.

Other suitable monomers (2) are 2-hydroxyethyl (meth) acrylate, 2-hydroxyethyl ethacrylate, 2-hydroxypropyl (meth)acrylate, 3-hydroxypropyl (meth)acrylate, 3-hydroxybutyl (meth)acrylate, 4-hydroxybutyl (meth)acrylate, 6-hydroxyhexyl (meth)acrylate and mixtures thereof.

Other suitable monomers of group (2) are nitriles of α,β-ethylenically unsaturated mono- and dicarboxylic acids, such as, for example, acrylonitrile and methacrylonitrile.

Suitable monomers of group (2) are furthermore N-vinyllactams and derivatives thereof which may have, for example, one or more $C_1$-$C_6$-alkyl substituents (as defined above). These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Suitable additional monomers of group (2) are furthermore ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

The abovementioned monomers of group (2) can be used individually or in the form of any desired mixtures in the copolymerization with at least one anionic monomer.

A further modification of the copolymers is possible by using, in the copolymerization, monomers of group (3) which comprise at least two double bonds in the molecule, e.g. methylenebisacrylamide, glycol diacrylate, glycol dimethacrylate, glyceryl triacrylate, pentaerythrityl triallyl ether, polyalkylene glycols at least diesterified with acrylic acid and/or methacrylic acid or polyols, such as pentaerythritol, sorbitol or glucose. If at least one monomer of group (3) is used in the copolymerization, the amounts employed are up to 2 mol %, e.g. from 0.001 to 1 mol %.

Furthermore, it may be expedient in the polymerization to combine the use of above crosslinking agents with the addition of regulators. From 0.001 to 5 mol % of at least one regulator are typically used. All regulators known from the literature, such as mercaptoethanol, 2-ethylhexyl thioglycolate, thioglycolic acid, dodecyl mercaptan, sodium hypophosphite, formic acid and/or tribromochloromethane, may be used.

Homopolymers of ethylenically unsaturated C3- to $C_5$-carboxylic acids, in particular polyacrylic acid and polymethacrylic acid, and hydrolyzed homopolymers of maleic anhydride and of itaconic anhydride are preferably used as the anionic polymeric compound. Preferred anionic copolymers comprise, for example, (1) from 10 to 99% by weight of at least one ethylenically unsaturated $C_3$- to $C_5$-carboxylic acid and (2) from 90 to 1% by weight of at least one amide, nitrile and/or ester of an ethylenically unsaturated C3- to $C_5$-carboxylic acid incorporated in the form of polymerized units. The sum of the percentage by weight of the components (1) and (2) is always 100. Copolymers of acrylic acid and acrylamide, copolymers of acrylic acid and acrylonitrile, copolymers of acrylic acid and N-vinylformamide, copolymers of methacrylic acid and methacrylamide, copolymers of methacrylic acid and N-vinylformamide, copolymers of acrylic acid and methacrylamide, copolymers of acrylic acid and methacrylonitrile, copolymers of methacrylic acid and methacrylonitrile and copolymers of acrylic acid, acrylamide and acrylonitrile are particularly preferred.

The anionic polymers are water-soluble. They can be used in the form of free acids and/or as alkali metal, alkaline earth metal or ammonium salt in the process according to the invention. They have, for example, a K value of from 50 to 250 (determined according to H. Fikentscher in 5% strength by weight aqueous sodium chloride solution at 25° C. and pH 7).

The water-soluble anionic polymer is used in the process according to the invention in an amount of, for example, from 0.01 to 2.0% by weight, preferably from 0.05 to 1.0% by weight, in particular from 0.1 to 0.5% by weight, based on dry paper stock. The weight ratio of cationic polymers (a) polymers comprising vinylamine units and (b) polymers comprising ethylenimine units to the water-soluble polymeric anionic compounds is, for example, from 3:1 to 1:3 and is preferably 1:1.

For papermaking, all qualities customary for this purpose are suitable as fibers for the production of the pulps, e.g. mechanical pulp, bleached and unbleached chemical pulp and paper stocks from all annual plants. Mechanical pulp includes, for example, groundwood, thermomechanical pulp (TMP), chemothermomechanical pulp (CTMP), pressure groundwood, semichemical pulp, high-yield pulp and refiner mechanical pulp (RMP). For example, sulfate, sulfite and soda pulps are suitable as chemical pulp. For example, unbleached chemical pulp, which is also referred to as unbleached kraft pulp, is used. Suitable annual plants for the production of paper stocks are, for example, rice, wheat, sugar cane and kenaf.

The process according to the invention is suitable in particular for the production of papers treated to impart dry strength and obtained from waste paper (comprising deinked waste paper), which is used either alone or as a mixture with other fibers. It is also possible to start from fiber mixtures comprising a primary stock and recycled coated broke, for example bleached pine sulfate mixed with recycled coated broke. The process according to the invention is of industrial interest for the production of paper, board and cardboard from waste paper and, in special cases, also from deinked waste paper, because it substantially increases the strength properties of the recycled fibers. It is particularly important for improving strength properties of graphic arts papers and of packaging papers.

The pH of the stock suspension is, for example, in the range from 4.5 to 8, in general from 6 to 7.5. For example, an acid, such as sulfuric acid, or aluminum sulfate can be used for adjusting the pH.

In the process according to the invention, the cationic polymers, namely (a) polymers comprising vinylamine units and (b) polymers comprising ethylenimine units, are preferably first metered into the paper stock. The cationic polymers can be added to the high-consistency stock (fiber concentration >15 g/l, e.g. in the range from 25 to 40 g/l up to 60 g/l) or preferably to a low-consistency stock (fiber concentration <15 g/l, e.g. in the range from 5 to 12 g/l). The point of addition is preferably situated before the wires but may also be situated between a shearing stage and a screen or thereafter. The metering of the cationic polymers (a) and (b) to the paper stock can be effected, for example, in succession, simultaneously or as a mixture of (a) and (b).

The anionic component is generally added only after the addition of the cationic polymers (a) and (b) to the paper stock but may also be metered simultaneously, but separately from the cationic polymers, into the paper stock. Furthermore, it is also possible to add first the anionic and then the cationic component or first to meter one of the cationic components (a) or (b) to the paper stock, then to add the anionic polymer and thereafter to add the other cationic component.

In the process according to the invention, the process chemicals usually used in papermaking can be employed in the customary amounts, e.g. retention aids, drainage aids, other dry strength agents, such as, for example, starch, pigments, fillers, optical brighteners, antifoams, biocides and paper dyes.

In the process according to the invention, papers which have been treated to impart dry strength and whose dry strength is greater compared with papers which are produced by known processes are obtained. Moreover, in the process according to the invention, the drainage rate is improved in comparison with known processes.

The stated percentages in the examples are percent by weight, unless stated otherwise. The K value of the polymers was determined according to Fikentscher, Cellulose-Chemie, volume 13, 58-64 and 71-74 (1932) at a temperature of 25° C. in 5% strength by weight aqueous sodium chloride solutions at a pH of 7 and a polymer concentration of 0.5%.

For the individual tests, sheets were produced in laboratory experiments in a Rapid-Köthen laboratory sheet former. The sheets were stored for 24 hours at 23° C. and a relative humidity of 50%. Thereafter, the following strength tests were carried out:

- bursting strength according to DIN ISO 2758 (up to 600 kPa), DIN ISO 2759 (from 600 kPa)
- SCT according to DIN 54518 (determination of the strip compressive strength)
- CMT according to DIN EN 23035 (determination of the flat crush resistance)
- DIN EN ISO 7263 (determination of the flat crush resistance on corrugated board after laboratory fluting)

EXAMPLES

The following polymers were used in the examples and in the comparative examples:

Polymer KA

Polyethylenimine (Polymin® P, BASF SE, D-67056 Ludwigshafen)

Polymer KB

An ethylenimine-grafted polyamidoamine crosslinked with a dichlorohydrin ether of polyethylene glycol, as described in DE-A 2434816, example 13, was used.

Polymer KC

A polyamidoamine which was grafted and crosslinked with ethylenimine and was additionally subjected to an ultrafiltration was used, cf. WO 00/67884, page 23, example B1b.

Polymer KD

A polyvinylformamide partly hydrolyzed to a degree of 30% and having a K value of 90, as described in DE-A 10 2004 056551, page 9, last section, as PVAm 4, was used.

Polymer KE

A polymer which was prepared by acid hydrolysis of a copolymer of 30 mol % of N-vinylformamide and 70 mol % of acrylonitrile, as described in DE 4328975 as example P on pages 8 and 9, was used.

Polymer KF

A commercially available Hofmann degradation product from SNF, having the designation RSL HF 70D, was used. The product had a solids content of 24.2%, a viscosity of 19 mPas (Brookfield, LVT, spindle 1, 60 rpm, 20° C.) and a charge density of 57.2 meq/100 g of product (polyelectrolyte titration).

Polymer KG

The polymer used was identical to the Hofmann degradation product designated in the Table on page 13 of WO 2006/075115 as C8 béta 2. It was prepared by reacting polyacrylamide with sodium hypochlorite in the molar ratio 1:1 and sodium hydroxide solution, the molar ratio of sodium hydroxide to sodium hypochlorite being 2:1.

Polymer KH

The polymer used was identical to the glyoxylated copolymer designated on page 15, line 23, of WO 2006/090076 as C2 and comprising 95 mol % of acrylamide and 5 mol % of diallyldimethylammonium chloride (DADMAC).

Polymer AA

Copolymer of 70% of N-vinylformamide and 30% of acrylic acid in the form of the sodium salt with a K value of 85, as described in the last section on page 9 of DE 10 2004 056551 as copolymer 4.

Polymer AB

The polymer used was identical to the copolymer designated in the Table on page 14 of WO 2006/075115 as A1 and comprising 70% of acrylamide and 30% of acrylic acid, in the form of the sodium salt.

Polymer AC

The polymer used was identical to the copolymer designated in the Table on page 14 of WO 2006/075115 as A2 and comprising 70 mol % of acrylamide and 30 mol % of acrylic acid, crosslinked with methylenebisacrylamide (MBA), in the form of the sodium salt. The copolymer had an anionic charge of 3.85 meq/g.

Polymer AD

The polymer used was identical to the copolymer designated in the Table on page 16 of WO 2006/090076 as A2 and comprising 70 mol % of acrylamide and 30 mol % of acrylic acid, crosslinked with methylenebisacrylamide (MBA), in the form of the sodium salt. The copolymer had an anionic charge of 3.85 meq/g.

Production of the Paper Stock for the Examples and Comparative Examples

A paper comprising 100% of waste paper (mixture of types: 1.02, 1.04, 4.01) was beaten with tap water at a consistency of 4% in a laboratory pulper free of fiber bundles and beaten to a freeness of 40° SR in a laboratory refiner. This stock was then diluted to a consistency of 0.7% with tap water.

Drainage Test

In the examples and comparative examples, in each case 1 liter of the paper stock described above was used and in each case the water-soluble polymers stated in each case in the Table were added in succession with stirring and drainage was then effected with the aid of a Schopper-Riegler drainage tester, the time in seconds for an amount (filtrate) of 600 ml to flow through being determined. The concentration of the water-soluble cationic and anionic polymers, which in each case were tested as dry strength agents for paper, was in each case 1%. The results of the measurements are shown in the Table.

Sheet Formation

In the examples and comparative examples, the polymers stated in the Table were added in succession to the paper stock described above with stirring. The polymer concentration of the aqueous solutions of the cationic and of the anionic polymers was in each case 1%. In the Table, the respective amounts of the polymers used, in percent by weight, based on the solids content of the paper stock, are stated. After the final addition of a water-soluble polymer to the paper stock, an amount of stock (about 500 ml) was taken off which was sufficient for producing a sheet having a basis weight of 120 g/m$^2$ (3.2 g oven dry) on a Rapid-Köthen sheet former. The sheets were pressed out as customary in the Rapid-Köthen method and were dried for 8 minutes at 110° C. in a drying cylinder. The results are shown in the Table.

TABLE 1

| Examples | Cationic Polymer 1 | Dose [%] | Cationic Polymer 2 | Dose [%] | Anionic Polymer | Dose [%] | Drainage time for 600 ml [s] | Bursting strength [kPa] | SCT [kN] | CMT 30 [N] |
|---|---|---|---|---|---|---|---|---|---|---|
| Comparison 1 | none | | none | | none | | 87 | 291 | 1.37 | 137 |
| Comparison 2 | Polymer KD | 0.3 | none | | Polymer AA | 0.3 | 72 | 375 | 2.04 | 180 |
| Comparison 3 | Polymer KG | 0.3 | none | | Polymer AB | 0.3 | 79 | 345 | 1.59 | 163 |
| Comparison 4 | Polymer KG | 0.3 | none | | Polymer AC | 0.3 | 76 | 358 | 1.61 | 170 |
| Comparison 5 | Polymer KH | 0.16 | Polymer KG | 0.14 | Polymer AD | 0.3 | 76 | 359 | 1.6 | 171 |
| Example 1 | Polymer KA | 0.1 | Polymer KD | 0.2 | Polymer AA | 0.3 | 69 | 376 | 2.06 | 180 |
| Example 2 | Polymer KB | 0.1 | Polymer KD | 0.2 | Polymer AA | 0.3 | 56 | 380 | 2.11 | 181 |
| Example 3 | Polymer KC | 0.1 | Polymer KD | 0.2 | Polymer AA | 0.3 | 50 | 385 | 2.17 | 186 |
| Example 4 | Polymer KC | 0.15 | Polymer KD | 0.15 | Polymer AA | 0.3 | 53 | 379 | 2.1 | 182 |
| Example 5 | Polymer KC | 0.2 | Polymer KD | 0.1 | Polymer AA | 0.3 | 60 | 377 | 2.05 | 181 |
| Example 6 | Polymer KC | 0.1 | Polymer KD | 0.2 | Polymer AB | 0.3 | 51 | 386 | 2.12 | 182 |
| Example 7 | Polymer KC | 0.1 | Polymer KD | 0.2 | Polymer AC | 0.3 | 50 | 388 | 2.16 | 185 |
| Example 8 | Polymer KC | 0.1 | Polymer KE | 0.2 | Polymer AA | 0.3 | 51 | 386 | 2.14 | 183 |
| Example 9 | Polymer KF | 0.2 | Polymer KA | 0.1 | Polymer AA | 0.3 | 77 | 358 | 1.6 | 170 |
| Example 10 | Polymer KF | 0.2 | Polymer KB | 0.1 | Polymer AA | 0.3 | 73 | 361 | 1.63 | 174 |
| Example 11 | Polymer KF | 0.2 | Polymer KC | 0.1 | Polymer AA | 0.3 | 67 | 368 | 1.67 | 177 |
| Example 12 | Polymer KF | 0.15 | Polymer KC | 0.15 | Polymer AA | 0.3 | 69 | 362 | 1.63 | 173 |
| Example 13 | Polymer KF | 0.1 | Polymer KC | 0.2 | Polymer AA | 0.3 | 74 | 359 | 1.6 | 173 |
| Example 14 | Polymer KF | 0.2 | Polymer KC | 0.1 | Polymer AB | 0.3 | 66 | 363 | 1.64 | 174 |
| Example 15 | Polymer KF | 0.2 | Polymer KC | 0.1 | Polymer AC | 0.3 | 64 | 365 | 1.68 | 177 |

Comparison 2 according to Example 6 of DE-A-10 2004 056551

Comparison 3 according to Example 17 of WO-A-2006/075115

Comparison 4 according to Example 1 of WO-A-2006/075115

Comparison 5 according to Example 5 of WO-A-2006/090076

We claim:

1. A process for producing paper, board or cardboard, comprising:

adding at least one water-soluble cationic polymer and at least one water-soluble polymeric anionic compound to a paper stock;

draining the paper stock with formation of a sheet;

drying the sheet; and, wherein the water-soluble cationic polymer comprises (a) a polymer comprising a vinylamine and (b) a polymer comprising an ethylenimine, wherein the water-soluble polymeric anionic compound carries at least one acid group or a salt thereof selected from the group consisting of a carboxyl group, a sulfo group and a phosphonic acid group, wherein the water-soluble polymeric anionic compound has a charge density of >0.5 meg/g, and wherein the addition metering of the water-soluble cationic polymer is effected by adding the polymer comprising a vinylamine and the polymer comprising an ethylenimine individually in sequence or a mixture thereof into the paper stock.

2. The process according to claim 1, wherein the polymer comprising vinylamine is obtained by polymerizing at least one monomer of the formula (I)

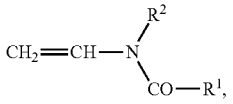

wherein $R^1$, $R^2$ are H or $C_1$- to $C_6$-alkyl, and subsequently eliminating partially or completely the —CO—$R^1$ group from the monomer (I) incorporated in a polymerized form into a polymer with formation of an amino group and/or by Hofmann degradation of a polymer which has an acrylamide and/or a methacrylamide.

3. The process according to claim 1, wherein the polymer comprising vinylamine is obtained polymerizing (i) at least one monomer of the formula (I)

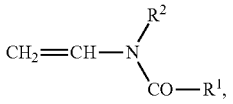

wherein $R^1$, $R^2$ are H or $C_1$- to $C_6$-alkyl, (ii) at least one monoethylenically unsaturated monomer and, (iii) at least one crosslinking monomer having at least two double bonds, and subsequently eliminating partially or completely the —CO—$R^1$ group from the monomer (I) incorporated in a polymerized form into a polymer with formation of an amino group.

4. The process according to claim 1, wherein the polymer comprising vinylamine is obtained polymerizing (i) at least one monomer of the formula (I)

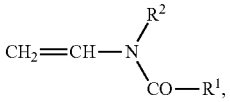

wherein $R^1$, $R^2$ are H or $C_1$- to $C_6$-alkyl, (ii,a) at least one second monomer selected from the group consisting of a monoethylenically unsaturated sulfonic acid, a monoethylenically unsaturated phosphonic acid, a monoethylenically unsaturated carboxylic acid having 3 to 8 carbon atoms, an alkali metal salt of the monoethylenically unsaturated sulfonic acid, an alkali metal salt of the monoethylenically unsaturated phosphonic acid, an alkali metal salt of the monoethylenically unsaturated carboxylic acid having 3 to 8 carbon atoms, an alkaline earth metal salt of the monoethylenically unsaturated sulfonic acid, an alkaline earth metal salt of the monoethylenically unsaturated phosphonic acid, an alkaline earth metal salt of the monoethylenically unsaturated carboxylic acid having 3 to 8 carbon atoms, an ammonium salt of the monoethylenically unsaturated sulfonic acid, an ammonium salt of the monoethylenically unsaturated phosphonic acid, and an ammonium salt of the monoethylenically unsaturated carboxylic acid having 3 to 8 carbon atoms, optionally (ii,b) at least one neutral and/or one cationic monomer and, optionally (iii) at least one crosslinking monomer having at least two double bonds and subsequently eliminating partially or completely the —CO—$R^1$ group from the monomer of the formula (I) which is incorporated a polymerized form into a polymer with formation of an amino group, wherein the content of the amino group in the polymer is at least 5 mol% above the content of an acid group of the monomer (ii,a) which is incorporated in a polymerized form.

5. The process according to claim 1, wherein the polymer comprising vinylamine is obtained by polymerizing a N-vinylformamide and subsequently eliminating a formyl group from a vinylformamide incorporated in a polymerized form into a polymer with formation of an amino group.

6. The process according to claim 1, wherein the polymer comprising vinylamine is obtained by polymerizing (i) vinylformamide and (ii) acrylonitrile and subsequently eliminating a formyl group from a vinylformamide incorporated in a polymerized form into the polymer with formation of an amino group.

7. The process according to claim 4, wherein the polymer comprising vinylamine is obtained by copolymerizing (i) a N-vinylformamide, (ii,a) an acrylic acid, a methacrylic acid and/or an alkali metal, an alkaline earth metal or an ammonium salt thereof and (ii,b) an acrylonitrile and/or a methacrylonitrile and subsequently eliminating partially or completely a formyl group from the N-vinylformamide incorporated in a polymerized form into a polymer with formation of an amino group, wherein the content of the amino group in the copolymer is at least 5 mol% above the content of an acid group of the monomer (ii,a) which is incorporated in a form of polymerized unit.

8. The process according to claim 1, wherein the polymer comprising vinylamine is obtained by Hofmann degradation of homo- or copolymers of a acrylamide or of a methacrylamide in an aqueous medium in the presence of a sodium hydroxide solution and a sodium hypochlorite and decarboxylating a carbamate group in the presence of an acid.

9. The process according to claim 1, wherein the polymer comprising ethylenimine comprises at least one water-soluble cationic polymer from the group consisting of a homopolymer of ethylenimine, a polyethylenimine reacted with at least bifunctional crosslinking agent, a polyamidoamine which has been grafted with an ethylenimine and reacted with at least bifunctional crosslinking agent, a reaction product of a polyethylenimine with a monobasic carboxylic acid to give an amidated polyethylenimine, a Michael adduct of a polyethylenimine with an ethylenically unsaturated acid, salt, ester, amide, or a nitrile of a monoethylenically unsaturated carboxylic acid, a phosphonomethylated polyethylenimine, a carboxylated polyethylenimine, and an alkoxylated polyethylenimine.

10. The process according to claim 9, wherein the polymer comprising ethylenimine comprises a homopolymer of an ethylenimine and/or a polyamidoamine grafted with an ethylenimine and subsequently reacted with a bifunctional crosslinking agent.

11. The process according to claim 1, wherein the polymeric anionic compound comprises at least one water-soluble compound selected from the group consisting of a polyacrylic acid, a polymethacrylic acid, a copolymer of acrylamide and an acrylic acid, a copolymer of an N-vinylformamide and an acrylic acid, a hydrolyzed copolymer of an N-vinylformamide and acrylic acid, a salt of the polyacrylic acid, a salt of the polymethacrylic acid, a salt of the copolymer of acrylamide and the acrylic acid, and a salt of the hydrolyzed copolymer of the N-vinylformamide and acrylic acid.

12. A paper which is obtained by the processes of claim 1.

13. The process according to claim 1, wherein the water-soluble polymeric anionic compound carries at least one carboxyl group or a salt thereof.

14. The process according to claim 1, wherein the water-soluble polymeric anionic compound carries at least one sulfo group or a salt thereof.

15. The process according to claim 1, wherein the water-soluble polymeric anionic compound carries at least one phosphonic acid group or a salt thereof.

16. The process according to claim 1, wherein the water-soluble polymeric anionic compound contains units derived from the polymerization of at least one monoethylenically unsaturated sulfonic acid, phosphonic acid or phosphoric acid ester, and at least one monoethlenically unsaturated mono-or dicarboxylic acid a salt thereof or a dicarboxylic anhydride.

* * * * *